US005634809A

United States Patent [19]

Hirai

[11] Patent Number: 5,634,809

[45] Date of Patent: Jun. 3, 1997

[54] CONNECTOR WITH LOCK MECHANISM

[75] Inventor: Yuji Hirai, Tokyo, Japan

[73] Assignee: Honda Tsushin Kogyo Kabushiki Kaisha Tsushin Kogyo Co. Ltd., Tokyo, Japan

[21] Appl. No.: 531,638

[22] Filed: Sep. 21, 1995

[30] Foreign Application Priority Data

Aug. 21, 1995 [JP] Japan ..... 7-212104

[51] Int. Cl.[6] ..... H01R 13/627

[52] U.S. Cl. ..... 439/352; 439/353; 439/358

[58] Field of Search ..... 439/345, 350, 439/352–358, 607–610

[56] References Cited

U.S. PATENT DOCUMENTS 4,954,097 9/1990 Sekiguchi ..... 439/352

5,171,161 12/1992 Kachlic ..... 439/352

5,435,744 7/1995 Derstine et al. ..... 439/352

*Primary Examiner*—Khiem Nguyen

*Attorney, Agent, or Firm*—Armstrong, Westerman, Hattori, McLeland & Naughton

[57] ABSTRACT

A connector with a lock mechanism has a connector main body in which are mounted electric contacts, a shield member for covering the connector main body and a connecting portion between the electric contacts and a cable, a casing for enclosing the connector main body and the shield member; and a lock mechanism for locking or unlocking a connection of the connector to a mating connector. The lock mechanism is made up of a flexible lock piece one end of which is connected to the shield member; a pair of lock release slide plates which are slidable along upper and lower main surfaces of the casing; and slide members which slide inside the casing by sliding of the slide plates so as to release the locking by the lock piece.

4 Claims, 5 Drawing Sheets

CONNECTOR WITH LOCK MECHANISM

BACKGROUND OF THE INVENTION

1. Field of the Invention

The present invention relates to a connector with a lock mechanism, which is built or assembled in an electronic data processing equipment, communication equipment, or the like, and in which the lock mechanism operates to lock or unlock the connector when it is connected to, or disconnected from, a mating connector.

2. Description of Related Art

There is conventionally known a cable connector (hereinafter simply called a connector) with a lock mechanism which locks the connection when the connector is connected to, or plugged into, a mating connector and which releases the locked condition when the connector is plugged out of the mating connector.

When a plurality of connectors each with a lock mechanism are connected to a back connector of a PC (personal computer) card while the connectors are disposed in close proximity to each other, there is a disadvantage in that they cannot be positioned too close to each other in case the lock mechanism is disposed on the right and left sides as seen in the direction of plugging in of each connector because a space for the manipulation of the lock mechanism must be secured.

SUMMARY OF THE INVENTION

In order to solve the above-described disadvantages in the conventional connectors, the present invention has an object of providing a connector which is free from the above-described disadvantages and which is small in the number of constituent parts and is therefore low in cost. According to the present invention, there is provided a connector with a lock mechanism having: a connector main body in which are mounted electric contacts; a shield member for covering the connector main body and a connecting portion between the electric contacts and a cable; a casing for enclosing the connector main body and the shield member; and a lock mechanism for locking or unlocking a connection of the connector to a mating connector; the improvement wherein the lock mechanism comprises: a flexible lock piece one end of which is connected to the shield member; a pair of lock release slide plates which are slidable along upper and lower main surfaces of the casing; and a slide member which slides inside the casing by sliding of the slide plates so as to release the locking of the lock piece.

Preferably, the casing has a recess respectively in the upper surface and the lower surface for containing therein each of the lock release slide plates.

The connector preferably further comprises a spring which is interposed between the slide member and the casing to urge the slide member in a direction of locking by the lock piece.

According to the above-described arrangement, at the time when the connector has been connected to the mating connector, the connection is locked by the lock piece. When the lock release slide plates are slid, the slide member slides inside the casing by the sliding of the slide plates, thereby operating the lock piece to release the locking. As a result, the connector can be detached from, or plugged out of, the mating connector. If the spring is provided between the slide member and the casing, the spring urges the slide member through its resilient force in the direction in which the locking by the lock piece is made. Therefore, when the connector has been connected to the mating connector, the lock piece will always be in the locked position without the need for returning the lock release slide plates back to their original position. The locking of the connector with the mating connector can thus be secured.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF A PREFERRED EMBODIMENT

Explanation will now be made about an embodying example of the present invention with reference to the accompanying drawings.

Figure 1:
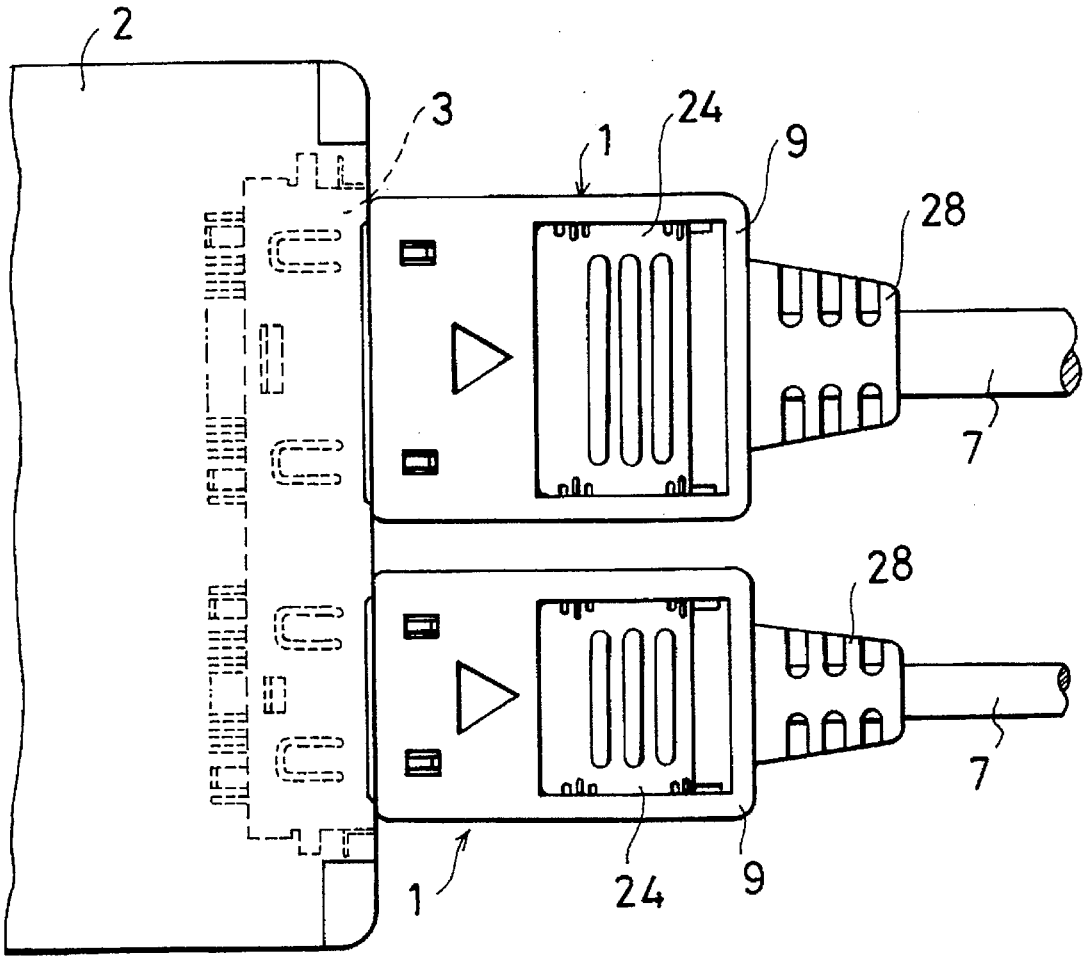
FIG. 1 is a plan view of two cable connectors, according to the present invention, which are connected to a PC card connector.

In FIG. 1 reference numerals 1, 1 denote connectors each having a lock mechanism according to the present invention. Reference numeral 2 denotes a PC card, reference numeral 3 denotes that back connector of the PC card which is to be connected to the connectors 1, 1. In the example shown in FIG. 1, two connectors 1, 1 having the numbers of electric contacts of 26 and 16, respectively, are connected to the back connector 3 of the PC card.

Figure 2A:
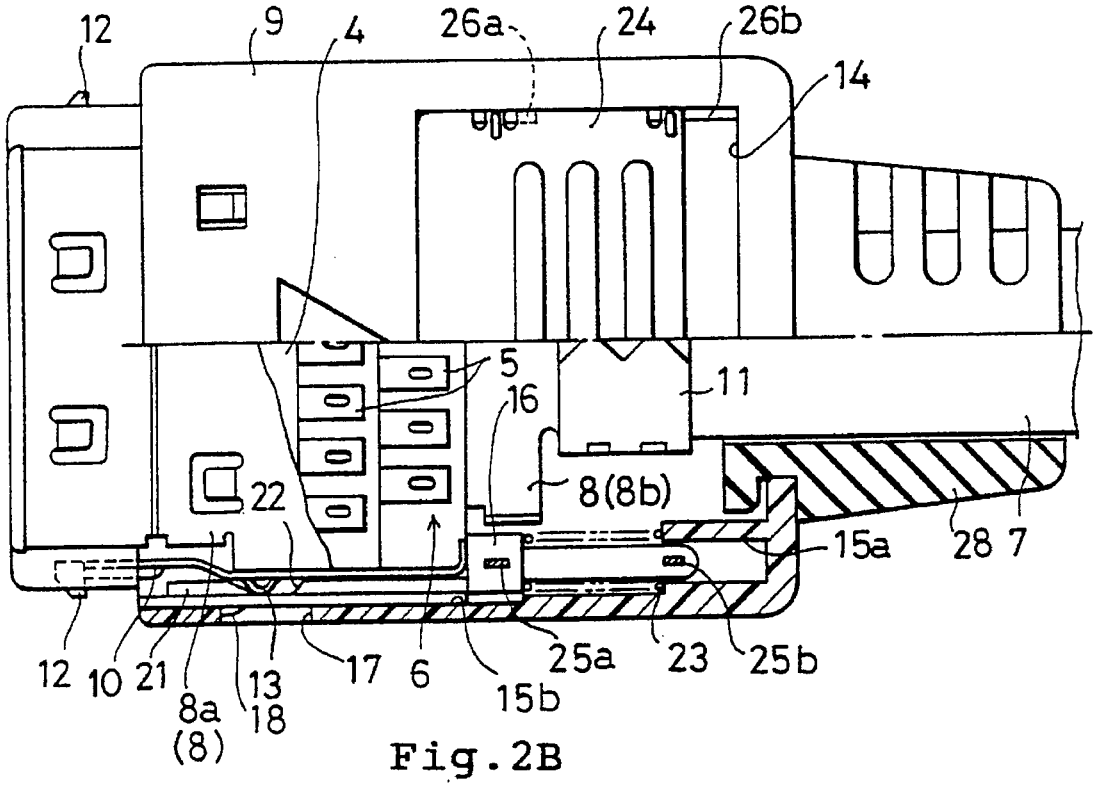
FIGS. 2A and 2B are a plan view, partly in section, and a front view, respectively, of the connector.
Figure 2B:
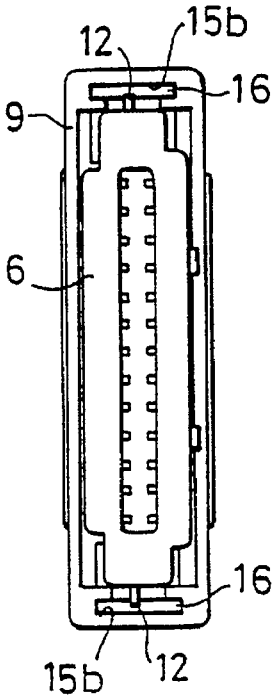
Figure 3A:
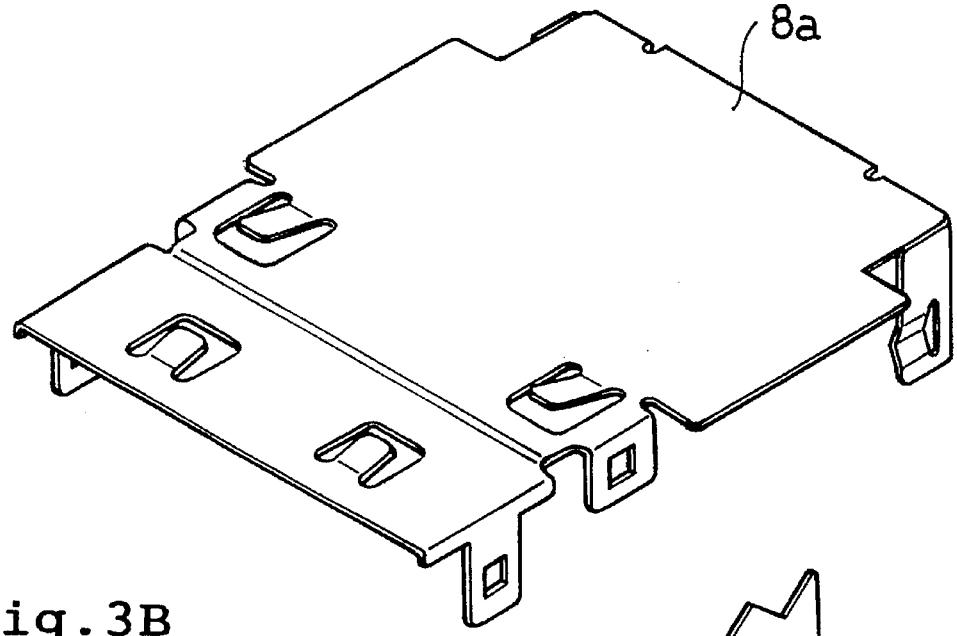
FIGS. 3A and 3B are a perspective view of an upper shield plate and a lower shield plate, respectively.
Figure 3B:
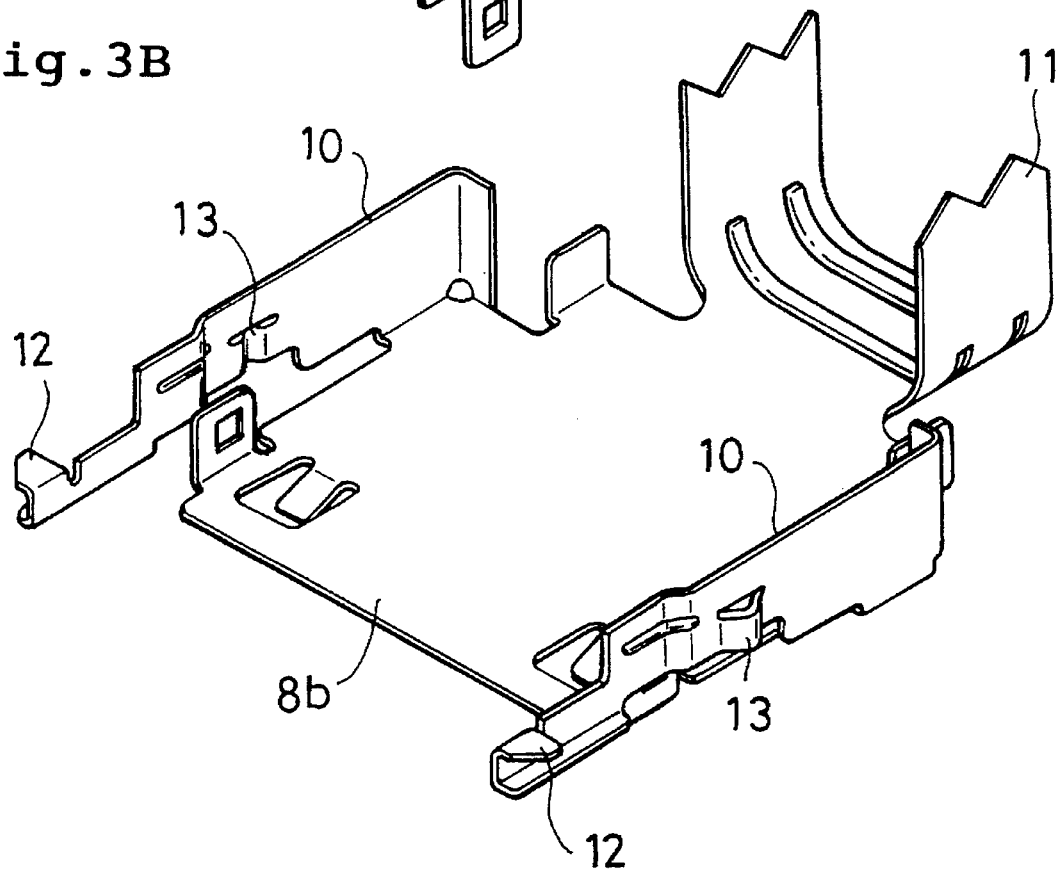

As shown in FIGS. 2A and 2B, the connector 1 is made up of a connector main body 6 in which female electric contacts 5 are mounted in a contact housing 4 made of an electrically insulating material, a shield member 8 which covers the connector main body 6 and a connecting portion (not shown) for connecting the female electric contacts 5 to a cable 7, and a casing 9 made of a synthetic resin for containing therein the connector main body 6 and the shield member 8. The shield member 8 is made, for example, of a stainless steel and is made up of an upper shield plate 8*a* and a lower shield plate 8*b* as shown in FIGS. 3A and 3B. In the lower shield plate 8*b* there are formed on both sides thereof flexible lock pieces 10, 10 one end of each of which is integrally connected to the lower shield plate 8*b*. Here in this specification, that side of the connector which is plugged into the back connector 3 of the PC card 2 is called a front side. The right or the left side is as seen in the direction of plugging in. In the rear end of the lower shield plate 8*b* there is formed a cable holding portion 11. Each of the lock pieces 10, 10 has a lock claw 12 on the opposite end thereof and an operating projection 13 in an intermediate portion thereof.

Figure 4:
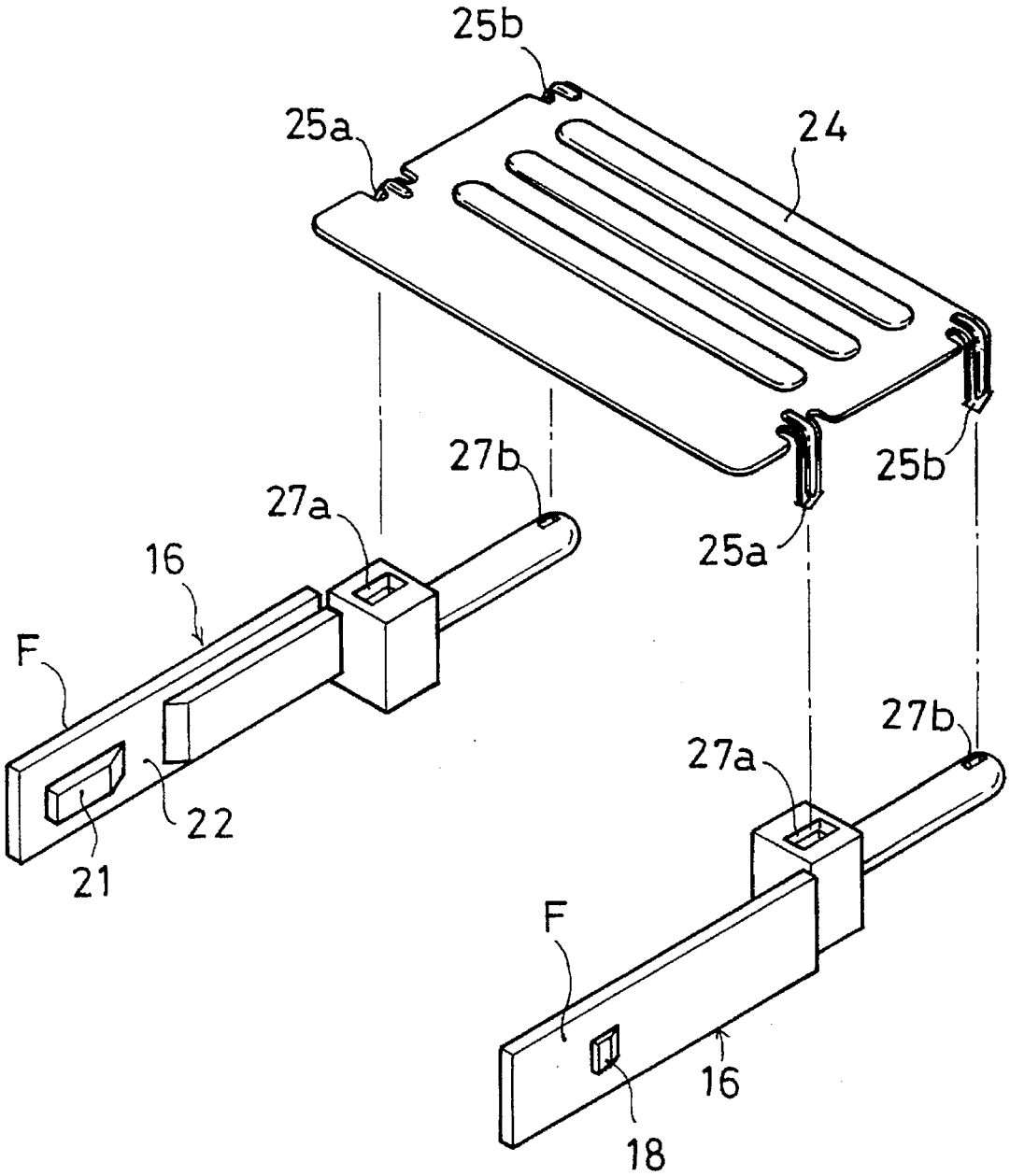
FIG. 4 is a perspective view of slide members and an upper lock release slide plate.

The casing 9 is rectangular in cross section and has an opening which is formed in the front end portion thereof for disposing therein part of the connector main body 6 in a projecting manner, and another opening which is formed in the rear end potion to extend the cable 7 outwards therefrom. On the outer upper and lower main surfaces of the casing 9 there are formed recesses 14, as shown in FIG. 2A, for disposing therein lock release slide plates 24, i.e., slide plates 24 for releasing the locking as described in detail hereinafter. On both inner sides of the casing 9, there are formed grooves 15*a*, 15*a* for guiding therein the sliding movement of the slide members 16, 16. As clearly shown in FIG. 4, the slide members 16, 16 are each constructed in the following manner. Namely, on an outer sliding surface F which slides along the inner surface of the casing 9, there is formed a projection 18 which engages with an opening 17 in the side surface of the casing 9 and which restricts the movable range of the slide member 16. On the inner side of each slide member 16 there are provided a projected portion 21 which operates to deflect the lock piece 10 upon the projected portion's engagement with the operating projection 13 of the lock piece 10 to thereby release the lock claw 12 on the front end out of engagement with an opening 20 (FIGS. 5A and 5B) in a lock receiving piece 19 of the connected PC card back connector 3, and a recessed portion 22 into which the operating projection 13 of the lock piece 10 is engaged to return the lock piece 10 back to the original position through its resiliency, whereby the lock claw 12 is engaged with the hole 20 to keep the lock claw 12 in a locked condition. Between the slide member 16 and the casing 9 there is interposed a compression spring 23 which urges the slide member 16 to move so that the recessed portion 22 engages with the operating projection 13 of the lock piece 10, thereby bringing about a locked condition. The lock releasing slide plates 24, 24 which engage with the recesses 14, 14 in the upper and lower main surfaces of the casing 9. As shown clearly in FIG. 4 (the slide plate on the lower main surface of the casing 9 is omitted in the Figure), on both sides of each lock release slide plate 24, there are provided connecting pieces 25*a*, 25*b* which are bent at right angles from the lock release slide plate 24. Each of the connecting pieces 25*a*, 25*b* is inserted from both the upper side and the lower side into holes 27*a*, 27*b* in the slide member 16 via holes 26*a*, 26*b* on both sides of the recess 14 in the upper and lower main surfaces of the casing 9, and are fixed therein.

An explanation will now be made about the operation of the connector with the above-described lock mechanism.

Figure 5A:
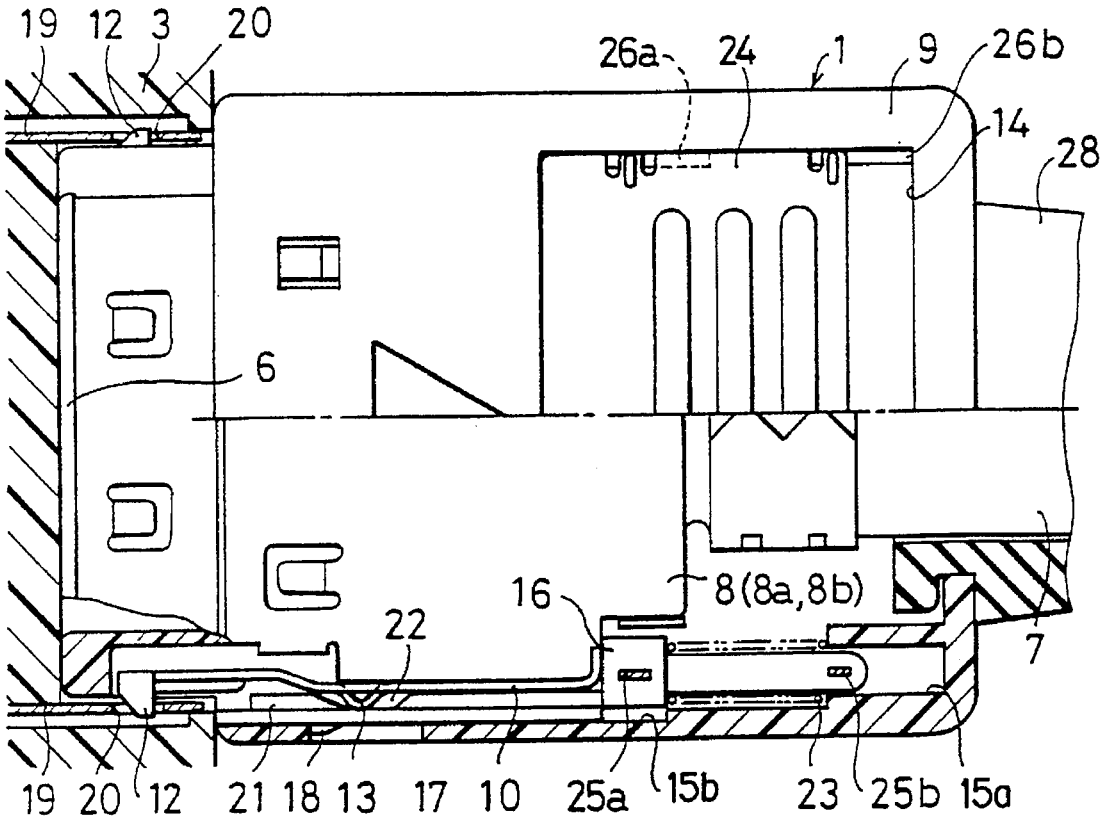
FIGS. 5A and 5B are plan views, partly in section, showing the locked condition and the unlocked condition of the connector and the PC card connector.
Figure 5B:
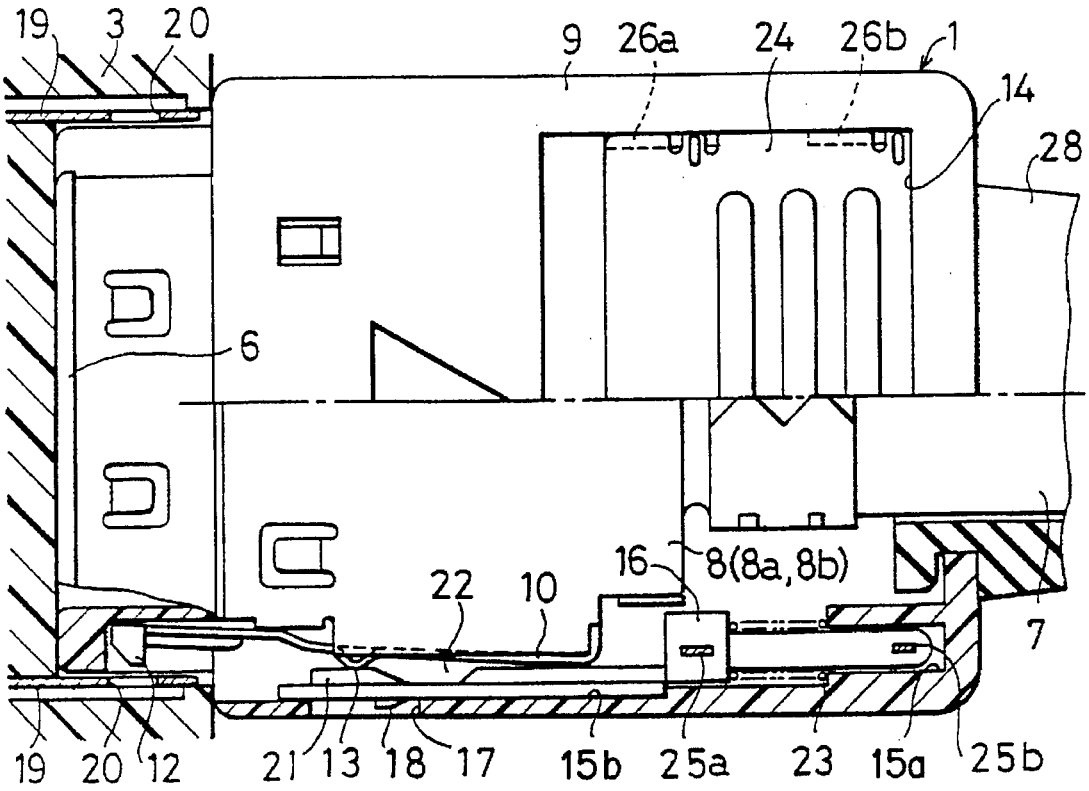

As shown in FIG. 1, in a condition in which two connectors 1, 1 which are in close proximity to each other are connected to the PC card back connector 3, the connection is locked as shown in FIG. 5A. When one of the connectors 1, 2 is to be plugged out of the PC card back connector 3, fingers of the operator are applied to the lock release slide plates 24, 24 on the upper and the lower main surfaces of the casing 9 and slide the plates 24, 24 to the condition shown in FIG. 5B, i.e., to the right in the Figure. The right and the left slide members 16, 16 inside the casing 9 will then move into the condition as shown in FIG. 5B. The lock claws 12 of the lock pieces 10 are released or freed from the holes 20 of the lock receiving pieces 19 of the PC card back connector 3 and the locking is thereby released. While leaving the lock release slide plates 24, 24 as they are, the connection between the connector 1 and the PC card back connector 3 can now be released. When the connector 1 is to be connected or plugged into the PC card back connector 3, the slide members 16 will slide back, without the aid of the fingers, to the original position due to the elastic force of the compression springs 23. The operating projections 13, 13 of the lock pieces 10, 10 are brought into engagement with the recessed portions 22, 22, whereby the lock pieces 10, 10 are locked. Reference numeral 28 denotes a bushing which is made of a soft polyvinyl chloride.

As has been explained hereinabove, according to the above-described arrangement of the present invention, it becomes possible to mount a plurality of connectors with lock mechanisms on the mating connector in close proximity to each other. Further, the connectors can be made thinner in the upper and lower (i.e., in their thickness) direction. Further, the connector of the present invention has an advantage in that the constituent parts may be small in number and the cost thereof is small.

It is readily apparent that the above-described connector with lock mechanism meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A connector with a lock mechanism comprising:

a connector main body in which are mounted electric contacts;

a shield member for covering said connector main body and a connecting portion between said electric contacts and a cable;

a casing for enclosing said connector main body and said shield member, said casing having a groove extending in a direction in which said connector is moved for locking and unlocking movements thereof to and from a mating connector; and a lock mechanism comprising a lock piece, a slide member, and a pair of lock release slide plates, wherein said lock piece has one end connected to said shield member and an opposite freely flexible end;

wherein said slide member is slidably disposed inside said groove for selectively engaging with said lock piece for said locking and unlocking movements; and wherein said pair of lock release slide plates are mounted on upper and lower main surfaces, respectively, of said casing, at least one of said lock release plates being operatively connected to said slide member.

2. The connector according to claim 1, wherein said casing has a recess respectively in said upper surface and said lower surface for containing therein each of said lock release slide plates.

3. The connector according to claim 1, further comprising a spring disposed between said slide member and said casing to urge said slide member in a direction of locking of said lock piece.

4. The connector according to any one of claims 1 through 3, wherein said at least one of said lock release slide plates has a connecting piece and wherein said slide member has an opening for receiving said connecting piece.

* * * * *